US012698543B2

(12) United States Patent
Tashima et al.

(10) Patent No.: US 12,698,543 B2
(45) Date of Patent: Aug. 4, 2026

(54) HOT-STRETCH-REDUCED ELECTRIC RESISTANCE WELDED PIPE

(71) Applicant: NIPPON STEEL CORPORATION, Tokyo (JP)

(72) Inventors: Kenzo Tashima, Tokyo (JP); Kensuke Nagai, Tokyo (JP); Tatsuo Yokoi, Tokyo (JP); Mitsuhiro Hamaishi, Tokyo (JP); Takashi Tsusue, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 372 days.

(21) Appl. No.: 18/547,624

(22) PCT Filed: Mar. 24, 2022

(86) PCT No.: PCT/JP2022/014175
§ 371 (c)(1),
(2) Date: Aug. 23, 2023

(87) PCT Pub. No.: WO2022/215548
PCT Pub. Date: Oct. 13, 2022

(65) Prior Publication Data

US 2024/0141451 A1 May 2, 2024

(30) Foreign Application Priority Data

Apr. 8, 2021 (JP) ..... 2021-065833

(51) Int. Cl.
*C21D 9/08* (2006.01)
*B21C 37/08* (2006.01)
(Continued)

(52) U.S. Cl.
CPC ..... *C21D 9/08* (2013.01); *B21C 37/08* (2013.01); *C21D 8/10* (2013.01); *C21D 9/50* (2013.01);
(Continued)

(58) Field of Classification Search
None
See application file for complete search history.

(56) References Cited

U.S. PATENT DOCUMENTS 6,290,789 B1 9/2001 Furukimi et al.
2021/0001425 A1* 1/2021 Aratani ..... C21D 9/085

FOREIGN PATENT DOCUMENTS

EP 2050833 A1 4/2009
JP 11080899 A 3/1999
(Continued)

OTHER PUBLICATIONS

Machine translation of JP2008-255394A. (Year: 2008).*

*Primary Examiner* — Xiaowei Su
(74) *Attorney, Agent, or Firm* — Greer, Burns & Crain, Ltd.

(57) ABSTRACT

A hot-stretch-reduced electric resistance welded pipe has a base metal portion and a weld portion, the base metal portion has a predetermined chemical composition, a Ti/N value obtained by dividing Ti content by N content is 3.0 or more, in a microstructure of the weld portion, the average grain diameter is 10.0 μm or less, the area ratio of ferrite is 20% or more, and the remaining structure includes at least one or more of pearlite and bainite/martensite, and in a texture of the weld portion, the accumulation intensity of a {001} plane is 6.0 or less, and a critical cooling rate Vc90 of the base metal portion is 5° C./s to 90° C./s.

2 Claims, 3 Drawing Sheets

(51) Int. Cl.

| | |
|---|---|
| ***C21D 8/10*** | (2006.01) |
| ***C21D 9/50*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |

(52) U.S. Cl.

CPC ..... *C22C 38/001* (2013.01); *C22C 38/002* (2013.01); *C22C 38/02* (2013.01); *C22C 38/04* (2013.01); *C22C 38/06* (2013.01); *C22C 38/14* (2013.01); *C21D 2201/00* (2013.01); *C21D 2211/002* (2013.01); *C21D 2211/005* (2013.01); *C21D 2211/008* (2013.01); *C21D 2211/009* (2013.01)

(56) References Cited

FOREIGN PATENT DOCUMENTS

| | | | | |
|---|---|---|---|---|
| JP | 2000094009 | A | | 4/2000 |
| JP | 2000096143 | A | | 4/2000 |
| JP | 2002020841 | A | | 1/2002 |
| JP | 2008255394 | A | * | 10/2008 |
| JP | 2019026910 | A | | 2/2019 |

* cited by examiner

HOT-STRETCH-REDUCED ELECTRIC RESISTANCE WELDED PIPE

TECHNICAL FIELD

The present invention relates to a hot-stretch-reduced electric resistance welded pipe.

Priority is claimed on Japanese Patent Application No. 2021-065833, filed Apr. 8, 2021, the content of which is incorporated herein by reference.

BACKGROUND ART

For example, in a member to which repetitive stress is applied such as automobile undercarriage parts or the like (fatigue-resistant member), while bar steel has been used in the related art, due to the need for reduction in weight, the shift from solid to hollow is progressing.

Such a member is required to have fatigue characteristics. However, when a ratio (t/D) of a wall thickness t to an outer diameter D of a steel pipe is small in a hollow steel pipe, it is difficult to obtain fatigue characteristics equivalent to those of a solid member, and in order to ensure fatigue characteristics, it is necessary to increase t/D. In order to meet these demands, steel pipes with a high ratio (t/D) between the wall thickness t and the outer diameter D are required. A hot-stretch-reduced electric resistance welded pipe manufactured by hot stretch reduction of an electric resistance welded pipe is suitable as a steel pipe with high t/D.

Excellent fatigue characteristics are required when the high t/D hot-stretch-reduced electric resistance welded pipe manufactured by performing such hot stretch reduction is used as a part, i.e., after being processed into the part and subjected to heat treatment. Meanwhile, since little impact load was added to the electric resistance welded steel pipe applied to the fatigue-resistant member during use, high toughness was not required.

For example, as a steel pipe for an automobile, Patent Document 1 discloses a steel pipe with good formability characterized in that an average of r values is 1.5 or more, and/or, a minimum value of the r values is 1.0 or more within a range of 0° to +250 in a steel pipe lengthwise direction.

However, in recent years, as the demand for high-strength electric resistance welded steel pipes has increased, it has also become necessary for the electric resistance welded steel pipes applied to fatigue-resistant members to have excellent toughness. When parts are manufactured using the electric resistance welded steel pipes, plastic deformation may be added to the electric resistance welded steel pipes, and this is because brittle fracture may occur during plastic deformation when the toughness of the electric resistance welded steel pipe deteriorates due to the increase in strength.

Based on the above background, in recent years, electric resistance welded steel pipes with excellent flattening performances have been required so as not to cause brittle fracture during plastic deformation when manufacturing parts. In the electric resistance welded steel pipes, an effective means for improving both strength and a flattening performance is refinement of crystal grains.

CITATION LIST

Patent Document

[Patent Document 1]
Japanese Unexamined Patent Application, First Publication No. 2002-20841

SUMMARY OF THE INVENTION

Problems to be Solved by the Invention

However, the inventors have found through examinations that, while an average grain diameter of ferrite can be reduced to about 4 to 5 μm or less with the above technology, development of a texture makes an electric resistance welded portion (hereinafter referred to as a weld portion) susceptible to cracking on one side, and a flattening performance of the electric resistance welded steel pipe deteriorates. In particular, they found that the high t/D hot-stretch-reduced electric resistance welded pipe is more susceptible to the texture because of the larger strain during the flattening test.

In consideration of the above-mentioned circumstances, the present invention is directed to providing a hot-stretch-reduced electric resistance welded pipe having an excellent flattening performance and excellent fatigue characteristics and high strength (high hardness) after heat treatment.

Means for Solving the Problem

The inventors have studied how to suppress cracks in the weld portion of the hot-stretch-reduced electric resistance welded pipe during plastic deformation. As a result, the inventors found that the occurrence of cracks in the weld portion could be suppressed and the flattening performance of the hot-stretch-reduced electric resistance welded pipe could be improved by refining the ferrite after hot stretch reduction and suppressing development of the texture.

The spirit of the present invention based on the above knowledge is as follows.

(1) A hot-stretch-reduced electric resistance welded pipe according to an aspect of the present invention has a base metal portion and a weld portion, a chemical composition of the base metal portion including, in mass %, C: 0.210 to 0.400%,
Si: 0.05 to 0.50%,
Mn: 0.50 to 1.70%,
P: 0.100% or less,
S: 0.010% or less,
N: 0.0100% or less,
Al: 0.010 to 0.100%,
Ti: 0.010 to 0.060%,
B: 0.0005 to 0.0050%,
Cr: 0 to 0.500%,
Mo: 0 to 0.500%,
Cu: 0 to 1.000%,
Ni: 0 to 1.000%,
Nb: 0 to 0.050%,
W: 0 to 0.050%,
V: 0 to 0.500%,
Ca: 0 to 0.0050%, and
REM: 0 to 0.0050%, in which a remaining consists of Fe and impurities, a Ti/N value obtained by dividing Ti content by N content is 3.0 or more, in a microstructure of the weld portion, an average grain diameter is 10.0 μm or less, an area ratio of ferrite is 20% or more, and a remaining structure includes at least one or more of pearlite and bainite/martensite, and in a texture of the weld portion, an accumulation intensity of a {001} plane is 6.0 or less, a critical cooling rate Vc90 of the base metal portion is 5° C./s to 90° C./s, and the critical cooling rate Vc90 is expressed as the following equation (1) when a B content exceeds 0.0004% and expressed as the following equation (3) when a B content is 0.0004% or less, providing that a C content (mass %) is [C], a Si content (mass %) is [Si], a Mn content (mass %) is [Mn], a Cr content (mass %) is [Cr], a Mo content (mass %) is [Mo], and a Ni content (mass %) is [Ni], $$\log_{10} Vc90=2.94-0.75\times\beta \quad (1)$$

$$\beta=2.7\times[C]+0.4\times[Si]+[Mn]+0.8\times[Cr]+2[Mo]+0.45\times[Ni] \quad (2)$$

$$\log_{10} Vc90=2.94-0.75(\beta'-1) \quad (3)$$

$$\beta'=2.7\times[C]+0.4\times[Si]+[Mn]+0.8\times[Cr]+[Mo]+0.45\times[Ni] \quad (4).$$

(2) In the hot-stretch-reduced electric resistance welded pipe according to the above-mentioned (1), the chemical composition may include, in mass %, at least one or two or more selected from the group consisting of:

Mo: 0.010 to 0.500%,

Cu: 0.010 to 1.000%,

Ni: 0.010 to 1.000%,

Nb: 0.005 to 0.050%,

W: 0.010 to 0.050%,

V: 0.010 to 0.500%,

Ca: 0.0001 to 0.0050%, and

REM: 0.0001 to 0.0050%.

Effects of the Invention

According to the aspect of the present invention, it is possible to provide a hot-stretch-reduced electric resistance welded pipe having an excellent flattening performance and excellent fatigue characteristics and high hardness after heat treatment.

The hot-stretch-reduced electric resistance welded pipe according to the aspect can be appropriately applied to undercarriage parts of an automobile, for example, a stabilizer, a drive shaft, a rack bar, and the like.

EMBODIMENT(S) FOR IMPLEMENTING THE INVENTION

Figure 1:
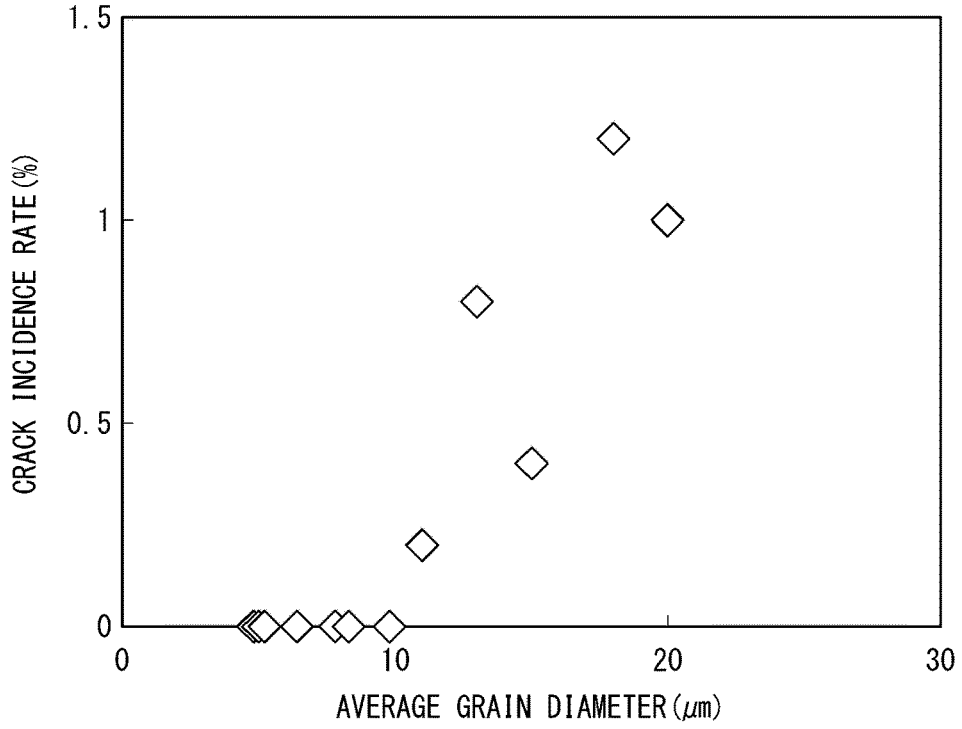
FIG. 1 is a view showing a relation between the average grain diameter and the crack incidence rate of a microstructure in a weld portion.

Hereinafter, an electric resistance welded steel pipe (hereinafter referred to as a hot-stretch-reduced electric resistance welded pipe) according to an embodiment will be described in detail. However, the present invention is not limited to only the configuration disclosed in the embodiment, and various changes may be made without departing from the spirit of the present invention.

The hot-stretch-reduced electric resistance welded pipe is a steel pipe manufactured by heating and hot-stretch-reduction processing the electric resistance welded steel pipe and becomes a product without cold forming after the hot stretch reduction processing, but the electric resistance welded steel pipe obtained by the cold forming (in general, the cold processed steel pipe is referred to as an electric resistance welded steel pipe) is a product after cold forming. For this reason, in a tensile test in a lengthwise direction, the electric resistance welded steel pipe obtained by cold forming is work-hardened by cold strain and yield strength is increased. Accordingly, the yield ratio (yield strength/tensile strength) of the electric resistance welded steel pipe is higher than that of the hot-stretch-reduced electric resistance welded pipe. Accordingly, the hot-stretch-reduced electric resistance welded pipe according to the embodiment and the electric resistance welded steel pipe obtained by cold forming can be distinguished from the results of the tensile test in the lengthwise direction. Specifically, the cold-formed pipe scores 95% or more and the hot-stretch-reduced electric resistance welded pipe less than 95% on the tensile test in the steel pipe lengthwise direction.

A numerical limitation range described with "to" therebetween includes the lower limit value and the upper limit value. Numerical values indicated as "less than" and "greater than" are not included in the numerical range. All "%" in chemical compositions refer to "mass %."

A base metal portion chemical composition, in mass %, of the hot-stretch-reduced electric resistance welded pipe according to the embodiment is C: 0.210 to 0.400%, Si: 0.05 to 0.50%, Mn: 0.50 to 1.70%, P: 0.100% or less, S: 0.010% or less, N: 0.0100% or less, Al: 0.010 to 0.100%, Ti: 0.010 to 0.060%, B: 0.0005 to 0.005%, and a remaining: Fe and impurities. Hereinafter, each of the elements will be described.

Further, the weld portion (which may be referred to as an electric resistance welded portion) in the embodiment is an abutting surface and a peripheral part thereof, and a base metal portion indicates a region other than the weld portion.

C: 0.210 to 0.400%

C is an element that contributes to improvement of hardness of steel. When the C content is less than 0.210%, desired hardness cannot be obtained after heat treatment. For this reason, the C content is 0.210% or more. It is preferably 0.230% or more, and more preferably 0.240% or more. The C content is more preferably greater than 0.300%.

On the other hand, when the C content exceeds 0.400%, a large amount of cementite is formed, and the flattening performance of the hot-stretch-reduced electric resistance welded pipe deteriorates. For this reason, the C content is 0.400% or less.

It is preferably 0.380% or less, and more preferably 0.360% or less.

Si: 0.05 to 0.50%

Si is an element that enhances fatigue characteristics of steel by strengthening the steel through solid-solution strengthening. When the Si content is less than 0.05%, the fatigue characteristics of the steel deteriorate. For this reason, the Si content is 0.05% or more. Preferably, the Si content is 0.10% or more, more preferably 0.20% or more, and further preferably 0.25% or more.

On the other hand, when the Si content exceeds 0.50%, Mn and/or Si-based oxide is formed in the electric resistance welded portion, which deteriorates the flattening performance and fatigue characteristics of the hot-stretch-reduced electric resistance welded pipe. For this reason, the Si content is 0.50% or less. It is preferably 0.45% or less, and more preferably 0.40% or less.

Mn: 0.50 to 1.70%

Mn is an important element for improving solid-solution strengthening and hardenability. When the Mn content is less than 0.50%, desired hardness cannot be obtained after quenching processing. For this reason, the Mn content is 0.50% or more.

It is preferably 0.70% or more, and more preferably 0.90% or more.

On the other hand, when the Mn content exceeds 1.70%, sulfides such as MnS are formed, and fatigue characteristics, especially fatigue characteristics of the electric resistance welded portions, deteriorate. For this reason, the Mn content is 1.70% or less. It is preferably 1.50% or less, and more preferably 1.50% or less.

P: 0.100% or Less

While P is an element that has a solid-solution strengthening action, when the P content exceeds 0.100%, it causes grain boundary embrittlement and the flattening performance of the hot-stretch-reduced electric resistance welded pipe deteriorates. For this reason, the P content is 0.100% or less. It is preferably 0.080% or less, and more preferably 0.060% or less.

While the P content is preferably lower and more preferably 0%, when the P content is excessively reduced, the cost of removing P will increase significantly. For this reason, the P content may be 0.001% or more.

S: 0.010% or Less

S is an element that causes fatigue characteristics of the hot-stretch-reduced electric resistance welded pipe to deteriorate by forming sulfides. When the S content exceeds 0.010%, the fatigue characteristics of the hot-stretch-reduced electric resistance welded pipe, particularly the fatigue characteristics of the electric resistance welded portion, significantly deteriorate. For this reason, the S content is 0.010% or less, preferably 0.008% or less, and more preferably 0.006% or less.

While the S content is preferably lower and more preferably 0%, when the S content is excessively reduced, the cost of removing S will increase significantly. For this reason, the S content may be 0.0001% or more.

N: 0.0100% or Less

N is an element that reduces the hardenability of steel by precipitating BN. When the N content exceeds 0.0100%, the desired hardness cannot be obtained after heat treatment, and the fatigue characteristics deteriorate. For this reason, the N content is 0.0100% or less. It is preferably 0.0080% or less, and more preferably 0.0060% or less.

While the N content is preferably lower and more preferably 0%, when the N content is excessively reduced, the cost of removing N will increase significantly. For this reason, the N content may be 0.0005% or more.

Al: 0.010 to 0.100%

Al is an effective element as a deoxidation material. When the Al content is less than 0.010%, the flattening performance of the hot-stretch-reduced electric resistance welded pipe deteriorates. For this reason, the Al content is 0.010% or more. It is preferably 0.030% or more, and more preferably 0.050% or more.

On the other hand, when the Al content exceeds 0.100%, a large amount of Al oxide is formed and the flattening performance of the electric resistance welded portion of the hot-stretch-reduced electric resistance welded pipe deteriorates. For this reason, the Al content is 0.100% or less. It is preferably 0.090% or less, and more preferably 0.080% or less.

Ti: 0.010 to 0.060%

Ti is an element that refines crystal grains and contributes to improvement of a flattening performance of the hot-stretch-reduced electric resistance welded pipe. When the Ti content is less than 0.010%, the flattening performance of the hot-stretch-reduced electric resistance welded pipe deteriorates. For this reason, the Ti content is 0.010% or more. It is preferably 0.015% or more, and more preferably 0.020% or more.

On the other hand, when the Ti content exceeds 0.060%, the flattening performance deteriorates due to the formation of coarse Ti carbonitrides. For this reason, the Ti content is 0.060% or less. It is preferably 0.050% or less, and more preferably 0.045% or less.

Furthermore, addition of Ti has the role of preventing formation of TiN and a decrease of solid solution N and a decrease of solid solution B, which contributes to hardenability due to BN precipitation. In this case, Ti>3.4 N is preferable.

B: 0.0005 to 0.0050%

B is an element that segregates at the grain boundary and contributes to the hardenability of steel. When the B content is less than 0.0005%, desired hardness cannot be obtained after heat treatment, and fatigue characteristics deteriorate. For this reason, the B content is 0.0005% or more. It is preferably 0.0010% or more, and more preferably 0.0020% or more.

On the other hand, when the B content exceeds 0.0050%, B-containing precipitation such as $B_{23}(CB)_6$ precipitates, resulting in a decrease in hardenability, a failure to obtain desired hardness after heat treatment, and deterioration in fatigue characteristics. For this reason, the B content is 0.0050% or less. It is preferably 0.0040% or less.

A remaining of the chemical composition of the base metal portion of the hot-stretch-reduced electric resistance welded pipe according to the embodiment may be Fe and impurities. In the embodiment, the impurities are those that are mixed from minerals as raw materials, scraps, a manufacturing environment, or the like, or allowable in a range that does not exert a bad influence on characteristics of the hot-stretch-reduced electric resistance welded pipe according to the embodiment. Examples of the impurities include Sn, Pb, Co, Sb, As, and the like.

The base metal portion of the hot-stretch-reduced electric resistance welded pipe according to the embodiment may contain the following arbitrary elements instead of some of the Fe. A lower limit of the content when the arbitrary elements are not contained is 0%. The chemical composition of the base metal portion may include, in mass %, one or two or more selected from the group consisting of Mo: 0.010 to 0.500%, Cu: 0.010 to 1.000%, Ni: 0.010 to 1.000%, Nb: 0.005 to 0.050%, W: 0.010 to 0.050%, V: 0.010 to 0.500%, Ca: 0.0001 to 0.0050%, and REM: 0.0001 to 0.0050%. Hereinafter, each of the arbitrary elements will be described.

Cr: 0 to 0.500%

Cr is an element that improves the hardness of steel by enhancing precipitation strengthening and hardenability. For this reason, Cr may be contained if necessary. In order to reliably obtain the above-mentioned effects, the Cr content is desirably 0.010% or more. It is preferably 0.030% or more, and more preferably 0.100% or more. The lower limit of the Cr content is 0% because it does not need to be contained.

On the other hand, when the Cr content exceeds 0.500%, Cr oxide is generated in the weld portion, and the flattening performance and fatigue characteristics of the hot-stretch-reduced electric resistance welded pipe deteriorate. For this reason, the Cr content is 0.500% or less. It is preferably 0.260% or less, and more preferably 0.240% or less.

Mo: 0 to 0.500%

Mo is an element that improves hardenability and at the same time contributes to the improvement of hardness after heat treatment by forming carbonitrides. For this reason, Mo may be contained if necessary. In order to reliably obtain the above-mentioned effects, the Mo content is preferably 0.010% or more. The lower limit of the Mo content is 0% because it does not need to be contained.

Even if the Mo content exceeds 0.500%, the above effect is saturated, so the Mo content is 0.500% or less.

Cu: 0 to 1.000%

Cu is an element that improves the hardenability of steel and improves the hardness after heat treatment. For this reason, Cu may be contained if necessary. In order to reliably obtain the above-mentioned effects, the Cu content is preferably 0.010% or more. The lower limit of the Cu content is 0% because it does not need to be contained.

On the other hand, when the Cu content exceeds 1.000%, the steel becomes brittle due to Cu precipitation. For this reason, the Cu content is 1.000% or less.

Ni: 0 to 1.000%

Ni is an element that improves the hardenability of steel and suppresses Cu brittleness. For this reason, Ni may be contained if necessary. In order to reliably obtain the above-mentioned effects, the Ni content is preferably 0.010% or more. The lower limit of the Ni content is 0% because it does not need to be contained.

On the other hand, when the Ni content exceeds 1.000%, the weldability of the hot-stretch-reduced electric resistance welded pipe decreases. For this reason, the Ni content is 1.000% or less.

Nb: 0 to 0.050%

Nb is an element that improves toughness of the hot-stretch-reduced electric resistance welded pipes by making the crystal grains finer. For this reason, Nb may be contained if necessary. In order to reliably obtain the above-mentioned effect, the Nb content is preferably 0.005% or more. The lower limit of the Nb content is 0% because it does not need to be contained.

On the other hand, when the Nb content exceeds 0.050%, the flattening performance of the hot-stretch-reduced electric resistance welded pipe deteriorates due to the formation of coarse Nb carbonitrides. For this reason, the Nb content is 0.050% or less.

W: 0 to 0.050%

W is an element that forms carbides in steel and contributes to the improvement of steel hardness. For this reason, W may be contained if necessary. In order to reliably obtain the above-mentioned effects, the W content is preferably 0.010% or more. The lower limit of the W content is 0% because it does not need to be contained.

On the other hand, when the W content exceeds 0.050%, the flattening performance of the hot-stretch-reduced electric resistance welded pipe is decreased due to the formation of a large amount of carbides. For this reason, the W content is 0.050% or less.

V: 0 to 0.500%

V is a precipitation strengthening element. For this reason, V may be contained if necessary. In order to reliably obtain the above-mentioned effect, the V content is preferably 0.010% or more. The lower limit of the V content is 0% because it does not need to be contained.

On the other hand, when the V content exceeds 0.500%, the flattening performance of the hot-stretch-reduced electric resistance welded pipe deteriorates due to the formation of coarse V carbides. For this reason, the V content is 0.500% or less.

Ca: 0 to 0.0050%

Ca is an element that suppresses generation of stretched MnS by forming sulfides and contributes to improvement of the flattening performance of the hot-stretch-reduced electric resistance welded pipe. For this reason, Ca may be contained if necessary. In order to reliably obtain the above-mentioned effects, the Ca content is preferably 0.0001% or more, and more desirably 0.0005% or more. The lower limit of the Ca content is 0% because it does not need to be contained.

On the other hand, when the Ca content exceeds 0.0050%, a large amount of CaO is generated, and the flattening performance of the hot-stretch-reduced electric resistance welded pipe deteriorates. For this reason, the Ca content is 0.0050% or less.

REM: 0 to 0.0050%

REM, like Ca, is an element that suppresses generation of stretched MnS by forming sulfides and contributes to improvement of the flattening performance of the hot-stretch-reduced electric resistance welded pipe. For this reason, REM may be contained if necessary. In order to reliably obtain the above-mentioned effects, the REM content is preferably 0.0001% or more, and more desirably 0.0005% or more. The lower limit of the REM content is 0% because it does not need to be contained.

On the other hand, when the REM content exceeds 0.0050%, the number of REM oxides increases, and the flattening performance of the hot-stretch-reduced electric resistance welded pipe deteriorates. For this reason, the REM content is 0.0050% or less.

In the embodiment, the REM is any of the total 15 lanthanoid elements, and the REM content is the total amount of these elements.

Ti/N is a value obtained by dividing the Ti content by the N content, and is 3.0 or more.

When the N content is too high, the hardening effect of B cannot be sufficiently obtained due to the precipitation of BN. As a result, desired hardness cannot be obtained after heat treatment. Ti/N should be 3.0 or more in order to obtain the hardening effect of B by fixing N as TiN. It is preferably 3.4 or more, and more preferably 5.0 or more.

While the upper limit is not particularly limited, Ti/N may be 30.0 or less.

In the hot-stretch-reduced electric resistance welded pipe of the embodiment, it is important to ensure hardenability. As an index of hardenability, for example, the critical cooling rate Vc90 (° C./s) known for iron and steel, 74 (1988) P. 1073, is used. The critical cooling rate Vc90 is expressed as the following equation (1) when the boron (B)

content exceeds 0.0004 mass % and expressed as the following equation (3) when the B content is 0.0004 mass % or less, providing that the C content (mass %) is [C], the Si content (mass %) is [Si], the Mn content (mass %) is [Mn], the Cr content (mass %) is [Cr], the Mo content (mass %) is [Mo], and the Ni content (mass %) is [Ni]. The critical cooling rate means a cooling rate at which a volume fraction of martensite is 90% or more. Accordingly, the hardenability increases as the Vc90 decreases.

$$\log_{10} Vc90=2.94-0.75\times\beta \quad (1)$$

$$\beta=2.7\times[C]+0.4\times[Si]+[Mn]+0.8\times[Cr]+2[Mo]+0.45\times[Ni] \quad (2)$$

$$\log_{10} Vc90=2.94-0.75(\beta'-1) \quad (3)$$

$$\beta'=2.7\times[C]+0.4\times[Si]+[Mn]+0.8\times[Cr]+[Mo]+0.45\times[Ni] \quad (4)$$

In the hot-stretch-reduced electric resistance welded pipe of the embodiment, the critical cooling rate Vc90 of the base metal portion is 90° C./s or less. The critical cooling rate Vc90 is preferably 70° C./s or less. When the critical cooling rate Vc90 is 90° C./s or less, excellent hardenability is obtained. The lower limit of the critical cooling rate Vc90 is not particularly limited. The critical cooling rate Vc90 is 5° C./s or more. The critical cooling rate Vc90 is preferably 15° C./s or more.

Further, the chemical composition of the electric resistance welded portion of the hot-stretch-reduced electric resistance welded pipe according to the embodiment is basically the same as the chemical composition of the base metal portion, although the C content slightly decreases due to decarbonization. The fatigue characteristics can be obtained while securing hardness after predetermined heat treatment by satisfying the chemical composition.

Next, the weld portion of the hot-stretch-reduced electric resistance welded pipe (may be referred to as the electric resistance welded portion) according to the embodiment will be described in detail. In the weld portion of the hot-stretch-reduced electric resistance welded pipe according to the embodiment, the average grain diameter of a microstructure is 10.0 μm or less, the area ratio of ferrite is 20% or more, the remaining structure contains at least one or more of pearlite and bainite/martensite (bainite and martensite), and the accumulation intensity of a {001} plane in the texture of the weld portion is 6.0 or less.

Average Grain Diameter of Weld Portion: 10.0 μm or Less

The inventors found that the average grain diameter of 10.0 μm or less of the microstructure in the weld portion of the hot-stretch-reduced electric resistance welded pipe is one of effective requirements for suppressing cracks in the weld portion and improving the flattening performance of the hot-stretch-reduced electric resistance welded pipe. FIG. 1 shows a relation between the average grain diameter and the crack incidence rate of the microstructure in the weld portion. Further, in the example shown in FIG. 1, the average grain diameter of the microstructure is varied by changing a manufacturing condition using a steel type A of the following example, and presence/absence of cracks was evaluated by the same method as the following example. In the example in FIG. 1, an accumulation intensity of the {001} plane in the texture of the weld portion is 4 to 5. According to FIG. 1, it can be seen that the crack incidence rate can be reduced by setting the average grain diameter of the microstructure in the weld portion to 10.0 μm or less.

The average grain diameter of the microstructure in the weld portion is preferably 8.0 μm or less, more preferably 7.0 μm or less, and further preferably 6.0 μm or less.

The average grain diameter of the microstructure is 1.0 μm or more, 2.0 μm or more, and 3.0 μm or more. The average grain diameter of the microstructure in the base metal portion of the hot-stretch-reduced electric resistance welded pipe is substantially equal to the average grain diameter of the microstructure of the weld portion. Specifically, the average grain diameter of the microstructure in the base metal portion has a size of 50% to 200% when the average grain diameter of the weld portion is 100%.

Figure 5:
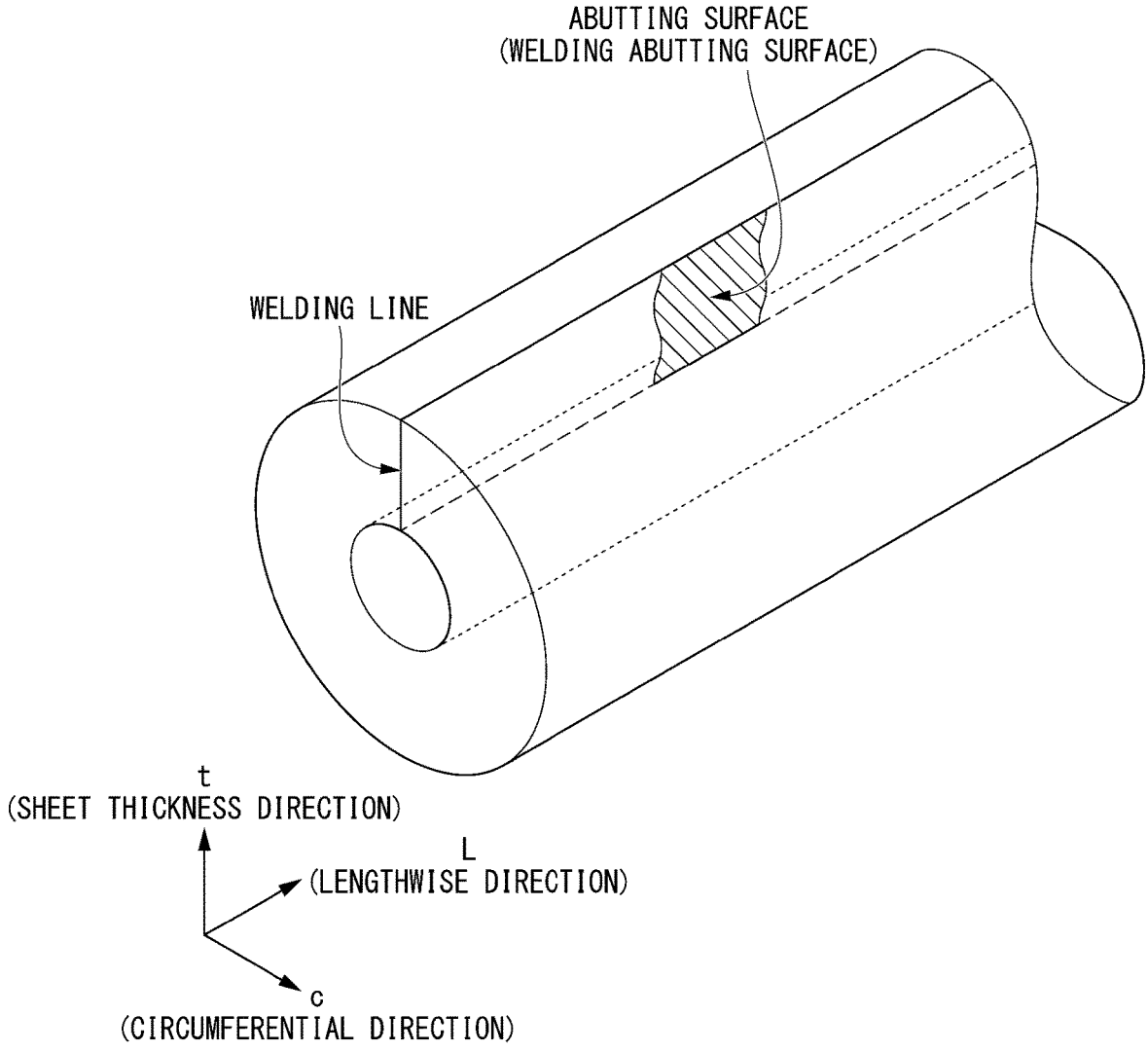
FIG. 5 is a view for describing a welding abutting surface.

The average grain diameter of the microstructure in the weld portion is measured by the following method. An observation surface is an abutting surface (welding abutting surface) of the weld portion of the hot-stretch-reduced electric resistance welded pipe. Specimens are collected in a surface perpendicular to a tube axis direction (lengthwise direction) so that a welding line indicating the abutting surface can be observed. The surface perpendicular to the tube axis direction of the collected specimen is polished to perform Nital corrosion, specifying the welding line. Further, the welding line is a region where decarbonization has occurred, and it can be easily identified because it is discolored white. The surface perpendicular to the circumferential direction including the welding line is an abutting surface (a shaded area of FIG. 5), which is cut and ground such that the surface becomes an observation surface within 50 μm laterally in the circumferential direction from the welding line so that the surface can be observed. That is, the electric resistance welded portion corresponds to a portion of 50 μm laterally with the welding abutting surface sandwiched therebetween.

After finishing the mirror surface by wet polishing the observation surface, electrolytic polishing is performed to remove a strained layer on the surface. A region of 500 μm×500 μm centered on ½ of the tube thickness of the observation surface is measured by an electron backscattering diffraction method at a measurement interval of 0.3 μm to obtain crystal orientation information using an EBSD device constituted by a thermal field emission type scanning electron microscope (JSM-7001F manufactured by JEOL Company) and an EBSD detector (DVC5 type detector manufactured by TSL). Here, the degree of vacuum in the EBSD device is $9.6\times10^{-5}$ Pa or less, the acceleration voltage is 15 kV, an irradiation electric current level is 13, and the irradiation level of an electron beam is 62.

Misorientation of neighboring measurement points is calculated from the obtained crystal orientation information. A boundary where the misorientation is 150 or more is defined as a crystal grain boundary, and a region surrounded by the crystal grain boundary is extracted as crystal grains of the microstructure. The average grain diameter of the microstructure is obtained by obtaining an equivalent circle diameter of the crystal grains extracted by an "area fraction" method and calculating the average value thereof. However, the crystal grains with the equivalent circle diameter of 0.50 μm or less are removed from a target of calculation of the average grain diameter. Further, when the base metal portion is observed, a surface perpendicular to the tube axis direction and the tube surface at a position separated by 90° in the circumferential direction of the steel pipe from the weld portion is observed. A specimen is collected such that the position separated by 90° in the circumferential direction of the steel pipe from the weld portion can be observed. The other conditions are observed like observation of the weld portion.

Area Ratio of Ferrite: 20% or More

When the area ratio of the ferrite in the microstructure of the weld portion is less than 20%, the flattening performance of the hot-stretch-reduced electric resistance welded pipe deteriorates. For this reason, the area ratio of the ferrite is 20% or more. It is preferably 30% or more, and more preferably 40% or more.

While an upper limit is not particularly limited, it may be 90% or less, or 80% or less.

Pearlite

In the weld portion of the hot-stretch-reduced electric resistance welded pipe according to the embodiment, pearlite is included. An area ratio of pearlite is preferably 80% or less from a relation of the area ratio of the ferrite, more preferably 70% or less, or 60% or less. In addition, when the area ratio of the pearlite is 20% or more, the flattening performance of the electric resistance welded steel pipe is preferably improved.

In the weld portion of the hot-stretch-reduced electric resistance welded pipe according to the embodiment, for example, bainite/martensite may be contained as a structure other than ferrite and pearlite. The remaining structure other than ferrite may be at least one or more of the pearlite and bainite/martensite. The area ratio of the structure other than ferrite and pearlite is preferably 2% or less.

The microstructure fraction in the weld portion is measured by the following method. The observation surface is the abutting surface of the hot-stretch-reduced electric resistance welded pipe like the observation surface of the texture. Collection of the specimens and processing of the observation surface are performed by the same method as in the case of the average grain diameter of the microstructure. A region of 500 μm×500 μm of ½ of a tube thickness of the observation surface is measured by an electron backscattering diffraction method at a measurement interval of 0.3 μm to obtain crystal orientation information using an EBSD device constituted by a thermal field emission type scanning electron microscope (JSM-7001F manufactured by JEOL) and an EBSD detector (DVC5 type detector manufactured by TSL). Here, the degree of vacuum in the EBSD device is 9.6×10−5 Pa or less, the acceleration voltage is 15 kV, the irradiation electric current level is 13, and the irradiation level of an electron beam is 62.

A region where misorientation (grain average misorientation (GAM) value) in crystal grains surrounded by a crystal grain boundary in which misorientation is 15° or more is 1° or less is extracted as ferrite and pearlite using a function installed in software "OIM Analysis (Registered Trademark)" attached to the EBSD analyzer from the obtained crystal orientation information, and a region where the GAM value exceeds 1° is extracted as bainite/martensite. In the specification, bainite and martensite are extracted without being distinguished therebetween. The area ratio of ferrite and pearlite and the area ratio of bainite/martensite are obtained by calculating the area ratios of the regions.

Next, the area ratio of the pearlite is measured by optical microscope observation. After finishing the same observation surface as the above-mentioned measurement with a mirror surface, Nital etching is performed. Accordingly, the pearlite is etched black and can be distinguished from the ferrite. While the pearlite has a structure in which ferrite and cementite are alternately provided in layers, when observed with an optical microscope, it appears black because the resolution is not high. Further, a layered ferrite and cementite structure can be directed determined by observation with a scanning electron microscope. The area ratio of the pearlite is obtained by calculating an area ratio of the black-etched area. In addition, the area ratio of the ferrite is obtained by subtracting the area ratio of the pearlite from "the area ratio of the ferrite and pearlite" obtained by measurement using the above-mentioned EBSD device.

Further, while the metal structure of the base metal portion is not particularly limited, it is preferable to have a metal structure that achieves desired hardness after heat treatment. For example, the structure may have ferrite: 20 to 80% and pearlite: 20 to 80%. The total area ratio of the ferrite and pearlite is 98% or more. Measurement of the area ratio may be performed by the same method as in the weld portion.

Texture of Weld Portion: Accumulation Intensity of {001} Plane is 6.0 or Less

Figure 2:
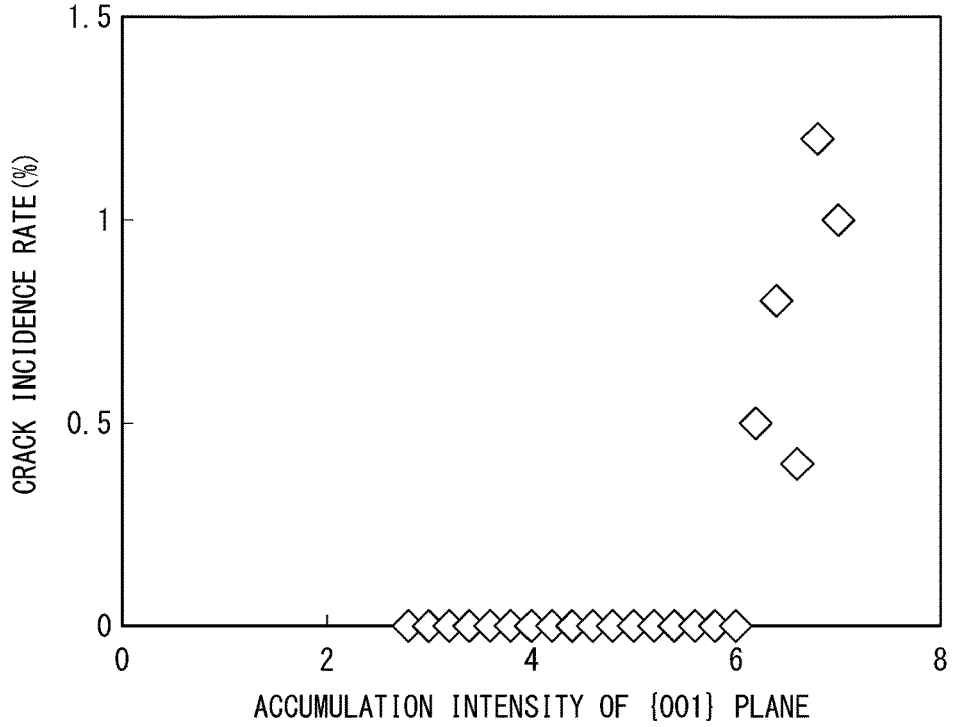
FIG. 2 is a view showing a relation between an accumulation intensity and a crack incidence rate of a {001} plane in a texture of the weld portion.

The inventors found that, in the texture of the weld portion, setting the accumulation intensity of the {001} plane to 6.0 or less is one of effective requirements for suppressing cracks in the weld portion and improving the flattening performance of the hot-stretch-reduced electric resistance welded pipe. FIG. 2 shows a relation between the accumulation intensity and the crack incidence rate of the {001} plane in the texture of the weld portion. Further, the example shown in FIG. 2, the accumulation intensity of the {001} plane is varied by changing the manufacturing condition using the steel type A of the following example, and presence/absence of the cracks was evaluated by the same method as in the following example. In the example in FIG. 2, the microstructure of the weld portion satisfies the above-mentioned average grain diameter and microstructure fraction. According to FIG. 2, it can be seen that the crack incidence rate can be reduced by setting the accumulation intensity of the {001} plane in the texture of the weld portion to 6.0 or less. Further, in the texture of the base metal portion, the accumulation intensity of the {001} plane is lower than in the weld portion. For example, the accumulation intensity may be 4.0 or less and lower than in the weld portion. In addition, the texture may be remained even after quenching and tempering.

The accumulation intensity of the {001} plane in the texture of the weld portion is preferably 5.0 or less, more preferably 4.5 or less, and further preferably 4.0 or less.

While the lower limit is not particularly limited, since it is 1.0 when the crystal orientation is random, it may be 1.0 or more.

Measurement of Texture

The texture in the weld portion is measured by the following method. The measurement surface is an abutting surface of the hot-stretch-reduced electric resistance welded pipe. Collection of the specimens and processing of the measurement surface (observation surface) are performed by the same method as in the case of measurement of the average grain diameter of the microstructure.

In the measurement, an EBSD device constituted by a thermal field emission type scanning electron microscope (JSM-7001F manufactured by JEOL) and an EBSD detector (DVC5 type detector manufactured by TSL) is used. Here, the degree of vacuum in the EBSD device is $9.6\times10^{-5}$ Pa or less, the acceleration voltage is 15 kV, the irradiation electric current level is 13, and the irradiation level of an electron beam is 62. Crystal orientation information is obtained by measuring a region of 1 mm×1 mm of a tube thickness ½ of the measurement surface at a measurement interval of 0.3 μm using an electron backscattering diffraction method.

The accumulation intensity of the {100} plane is a ratio between the {001} orientation and the random orientation, and specifically, for the obtained crystal orientation information, an accumulation intensity of the {001} plane parallel to the tube axis direction is calculated using a function of software "OIM Data Collection" attached to the EBSD analyzer and "OIM Analysis (Registered Trademark)." Accordingly, the accumulation intensity of the {001} plane in the texture of the weld portion is obtained.

Fatigue Characteristics after Heat Treatment: Fatigue Limit of 350 MPa or More

The hot-stretch-reduced electric resistance welded pipe used in the automobile undercarriage parts or the like is generally used after heat treatment after being processed into a part shape. For this reason, the hot-stretch-reduced electric resistance welded pipe is required to have excellent fatigue characteristics after heat treatment. In such a hot-stretch-reduced electric resistance welded pipe, a fatigue limit in a twist fatigue test after predetermined heat treatment is preferably 350 MPa or more. Further, fatigue breakdown occurs in the weld portion.

Heat treatment when the fatigue limit of the hot-stretch-reduced electric resistance welded pipe is measured will be described. In the embodiment, the heat treatment refers to the process of heating the hot-stretch-reduced electric resistance welded pipe to a temperature range of 850 to 1000° C., holding it within the temperature range for 10 to 1800 seconds, then, quenching of cooling it to a temperature range of a room temperature (about 25° C.) to 300° C. at an average cooling rate of 10° C./s or more, heating it to a temperature range of 200 to 420° C., and tempering of holding it within the temperature range for 5 to 60 minutes.

Further, the average cooling rate disclosed herein refers to a value obtained by dividing a difference between a temperature upon cooling start and a temperature upon cooling termination by a time between the cooling start and the cooling termination. In addition, to maintain it within the predetermined temperature range, the temperature may be kept constant or may be varied within the temperature range.

Next, a method of measuring a fatigue limit will be described. After the heat treatment is performed, a twist fatigue test of the hot-stretch-reduced electric resistance welded pipe is performed. The twist fatigue test is performed at a frequency of 10 Hz under a condition that a ratio between the minimum stress and the maximum stress (stress ratio) is −1. The fatigue limit is obtained by finding the maximum stress that does not break it in the number of cycles of 2,000,000 times.

Vickers Hardness after Heat Treatment: 450 Hv or More

The hot-stretch-reduced electric resistance welded pipe used in the automobile undercarriage parts or the like is generally used after heat treatment is performed after being processed in a part shape. For this reason, the hot-stretch-reduced electric resistance welded pipe is required to have high hardness after heat treatment. When Vickers hardness after heat treatment is less than 450 Hv, it may not be suitable for the undercarriage parts for an automobile. For this reason, the Vickers hardness after heat treatment is preferably 450 Hv or more. The Vickers hardness after heat treatment is 480 Hv or more, preferably 500 Hv or more.

While an upper limit of the Vickers hardness is not particularly limited, it may be 650 Hv or less, or 600 Hv or less.

A method of measuring Vickers hardness will be described. After heat treatment under the same condition as the heat treatment when the above-mentioned fatigue limit is measured, the Vickers hardness of the hot-stretch-reduced electric resistance welded pipe is measured. Specimens are collected such that cross sections perpendicular to the tube axis direction of the hot-stretch-reduced electric resistance welded pipe can be observed. The Vickers hardness is measured at all of 0.5 mm positions from an outer surface, 1 mm positions from the outer surface, tube thickness ½ positions, 0.5 mm positions from an inner surface and 1 mm positions from the inner surface at a 45° position, a 90° position, a 135° position, a 180° position, a 225° position and a 270° position when the abutting surface of the weld portion is 0° (a total of 30 places). The Vickers hardness after heat treatment is obtained by calculating the average value of the obtained Vickers hardness. Further, the applied load is 98 N.

While the tube thickness (wall thickness) t of the hot-stretch-reduced electric resistance welded pipe according to the embodiment is not particularly limited, it may be 2 mm to 15 mm.

The outer diameter D of the hot-stretch-reduced electric resistance welded pipe according to the embodiment is 10 mm to 45 mm.

A ratio t/D between the wall thickness t (mm) and the outer diameter D (mm) of the hot-stretch-reduced electric resistance welded pipe according to the embodiment is preferably 10% to 30%.

Next, a preferable method of manufacturing a hot-stretch-reduced electric resistance welded pipe according to the embodiment will be described.

First, in the present invention, the method of manufacturing the hot-rolled steel sheet, which is the raw material of the hot-stretch-reduced electric resistance welded pipe, is not particularly limited, and any conventional method can be applied. It is preferable to smelt the molten steel having the composition described above in a smelting furnace such as a converter or an electric furnace, and form steel pieces such as slabs by a continuous casting method or the like. The obtained steel piece is subjected to a heating process, a hot rolling process, a cooling process, and a winding process to manufacture a hot-rolled steel sheet. If the width of the hot-rolled steel sheet as it wound is too wide, it may be slit in the width direction to obtain a narrower coil (also referred to as a hoop).

A preferable method for manufacturing the hot-stretch-reduced electric resistance welded pipe according to the embodiment includes a process of roll-forming a hot-rolled steel sheet and electric-resistance welding butt joints, and a process of performing hot stretch reduction. Hereinafter, the processes will be described.

First, roll forming is performed on the hot-rolled steel sheet, and the abutting part (an end portion of the steel sheet) is electric-resistance welded. The electric resistance welding may be either electric resistance welding or high frequency welding. After the electric resistance welding, roundness is usually increased in a sizing process. Accordingly, the electric resistance welded pipe that is an element tube of the hot-stretch-reduced electric resistance welded pipe (hereinafter, referred to as the steel pipe in order to distinguish the hot-stretch-reduced electric resistance welded pipe according to the embodiment) is obtained.

Next, hot stretch reduction is performed on the steel pipe. The hot stretch reduction is performed by a stretch reducer after heating the steel pipe to a temperature range of 1100° C. or less and holding it within the temperature range for 10 to 300 seconds. In addition, when the heating temperature exceeds 1100° C. or a holding time exceeds 300 seconds, as austenite coarsens, the average grain diameter of the microstructure increases and the flattening performance deteriorates, which is not desirable. The purpose of heating is to heat the steel pipe to an austenite region, so the temperature is set to 900° C. or more.

The hot stretch reduction is preferably performed by a three-roll type stretch reducer, but there is no limitation thereto. In the stretch reducer, a plurality of stands preferably has a tandem arrangement, which is capable of continuous rolling.

While the number of passes for the hot stretch reduction is not specified, 10 to 30 passes are preferable. In order to set the average grain diameter of the microstructure of the weld portion to 10.0 μm or less, the rolling time (the elapsed time from the start of rolling in the first pass to the end of rolling in the final pass) is preferably 10 seconds or less. If the rolling time is too long, strain recovery proceeds, the number of nucleation sites during ferrite transformation decreases, and ferrite coarsens.

Figure 3:
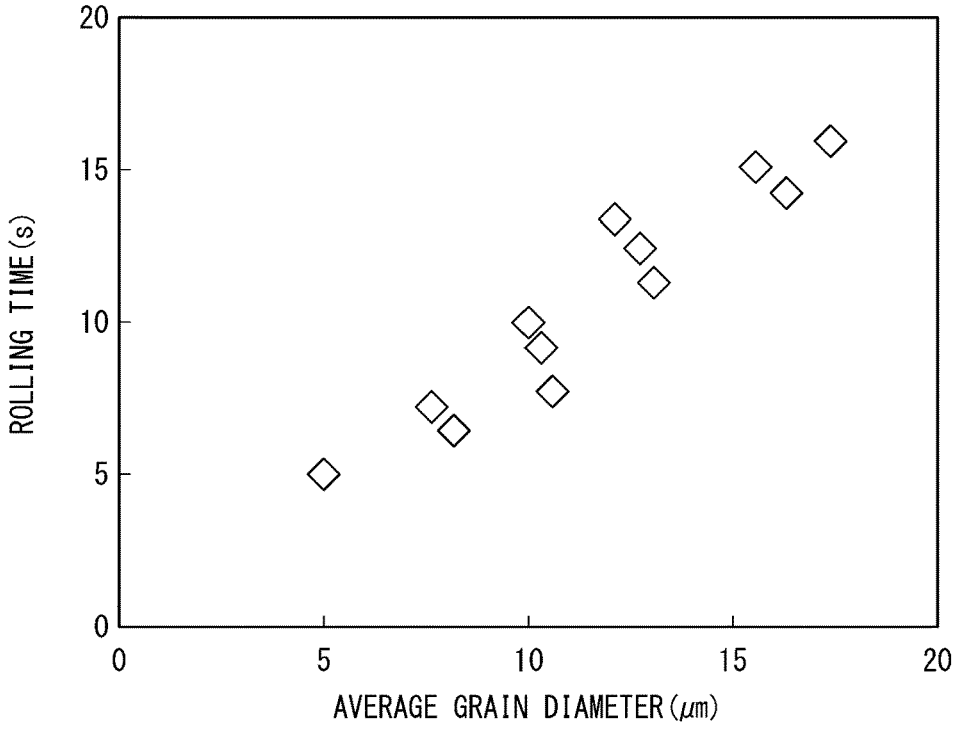
FIG. 3 is a view showing a relation between the average grain diameter and the rolling time of hot stretch reduction of the microstructure of the weld portion.

FIG. 3 shows a relation between the average grain diameter of the microstructure of the weld portion and the rolling time of the hot stretch reduction. Further, in the example shown in FIG. 3, the average grain diameter of the microstructure of the weld portion is changed by varying the rolling time of the hot stretch reduction using the steel type A of the following example. According to FIG. 3, it can be seen that, as the rolling time of the hot stretch reduction is reduced, the average grain diameter of the microstructure of the weld portion becomes finer. This is probably because the interpass time is reduced as the rolling time is shortened, the recovery of dislocations in the austenite is suppressed, and the ferrite after transformation becomes finer.

In the hot stretch reduction, it is preferable to control a cumulative reduction ratio in a temperature range of 650° C. or more and a cumulative reduction ratio in a temperature range of 850° C. or less. Further, the cumulative reduction ratio is defined as the % display of the value obtained by dividing the change in outer diameter before and after the hot stretch reduction by the outer diameter before the hot stretch reduction in the predetermined temperature range. In the temperature range of 650° C. or more, the hot stretch reduction is preferably performed so that the cumulative reduction ratio is 40.0% or more. The crystal grain diameter in the weld portion can be controlled by setting the cumulative reduction ratio to 40.0% or more in the temperature range of 650° C. or more.

While the upper limit of the cumulative reduction ratio in the temperature range is not specified, it is preferably 90.0% or less.

Figure 4:
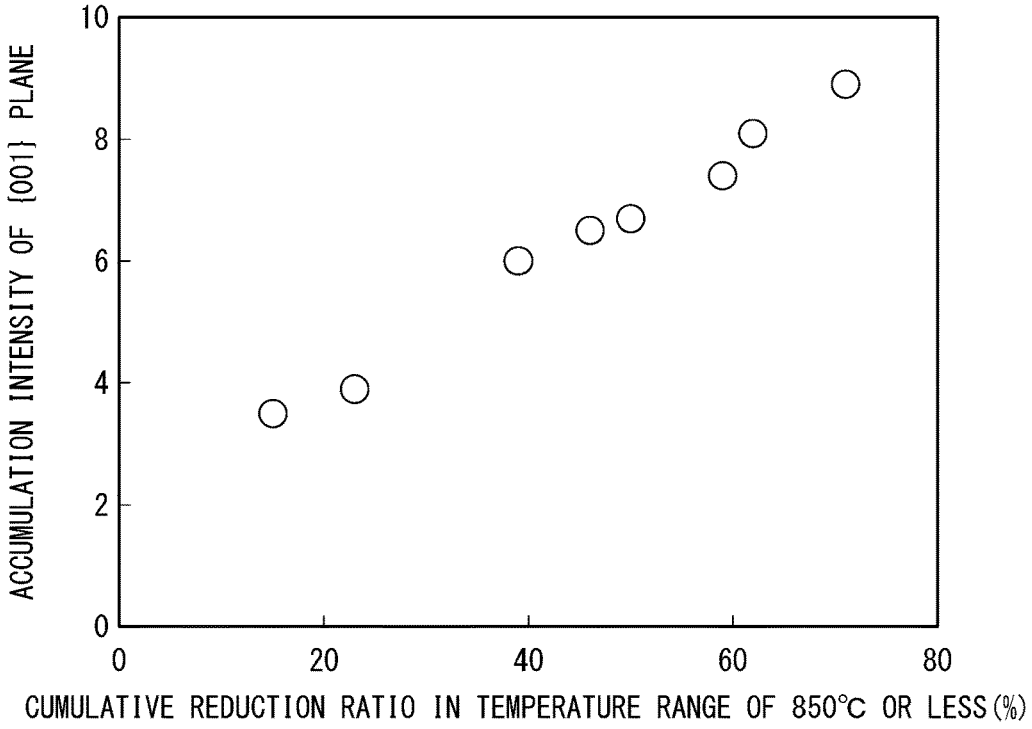
FIG. 4 is a view showing a relation between the cumulative reduction ratio within a temperature range of 850° C. or less and the accumulation intensity of the {001} plane in the texture of the weld portion.

The cumulative reduction ratio in the temperature range of 850° C. or less is preferably 40.0% or less. FIG. 4 shows a relation between a cumulative reduction ratio in a temperature range of 850° C. or less and an accumulation intensity of the {001} plane in the texture of the weld portion. Further, in the example shown in FIG. 4, an accumulation intensity of the {001} plane is changed by varying it using the steel type A of the following example. According to FIG. 4, it can be seen that the accumulation intensity of the {001} plane in the texture of the weld portion is set to 6.0 or less by setting the cumulative reduction ratio in the temperature range of 850° C. or less to 40.0% or less.

While the lower limit of the cumulative reduction ratio in the temperature range of 850° C. or less is not particularly limited, it may be 0.0% or more.

A finish temperature (an outlet-side temperature of the final pass) of the hot stretch reduction is preferably set to 650° C. or more in order to control the cumulative reduction ratio in the temperature range.

After the hot stretch reduction, it is preferable to cool it to a room temperature (about 25° C.) at an average cooling rate of 5° C./s or less. When the average cooling rate exceeds 5° C./s, a low temperature transformation structure is generated, and the area ratio of ferrite is less than 20%.

By the manufacturing method described above, the hot-stretch-reduced electric resistance welded pipe according to the present embodiment can be stably manufactured.

Example

Next, while the effects of one aspect of the present invention will be described in more detail with examples, the conditions in the example are one example of conditions adopted for confirming the operability and effect of the present invention and the present invention is not limited to this one example of conditions. Various conditions may be adopted for the present invention as long as the purpose of the present invention is achieved without departing from the spirit of the present invention.

Steel types with the chemical compositions shown in Table 1-1 and Table 1-2 were melted and hot-rolled to obtain hot-rolled steel sheets. Next, steel pipes shown in Table 3-1 and Table 3-2 were obtained by performing roll forming on the hot-rolled steel sheet and electric resistance welding of abutting parts (ends of the steel sheets). hot-stretch-reduced electric resistance welded pipes having wall thicknesses t, outer diameters D and t/D of Table 3-1 and Table 3-2 were obtained by performing hot stretch reduction on the steel pipes under conditions shown in Table 2-1 and Table 2-2. For this hot-stretch-reduced electric resistance welded pipe, observation of a structure and observation of a texture were carried out by the above-mentioned method. The obtained results are shown in Table 4-1 and Table 4-2. The average grain diameter of the base metal portion of No. 1 was 4.5 μm. P in a column of the remaining structure in Table 4-1 and Table 4-2 means pearlite, and B/M means bainite/martensite.

The obtained hot-stretch-reduced electric resistance welded pipe was cut to a length of 150 mm as a specimen, and a flattening test was performed. The hot-stretch-reduced electric resistance welded pipe was disposed such that the weld portion of the hot-stretch-reduced electric resistance welded pipe and a 180° position from the weld portion come into contact with a die of a press machine. The hot-stretch-reduced electric resistance welded pipe was pressed in a flat shape, and presence/absence of occurrence of cracks at this time was evaluated. The pressing was carried out until the distance between the inner surfaces of the weld portion and the 180° position from the weld portion was half the diameter. An impregnating method was applied to the inner surface of the steel pipe, and when cracks of 1 mm or more were observed, it was judged that cracks had occurred.

250 flattening tests were performed for each sample, and if no cracks occurred, the sample was judged to have excellent flattening performance and was marked as "OK" in the table. On the other hand, if even one crack occurred, it was determined to be unsatisfactory because it did not have excellent flattening performance, and was marked as "NG" in the table. The crack incidence rate was obtained by dividing the number of occurred cracks by 100, which is the parameter. In the flattening test, a sample with a crack incidence rate of 0% qualified.

The obtained hot-stretch-reduced electric resistance welded pipe was subjected to heat treatment (quenching, tempering) under the conditions shown in Table 2-1 and Table 2-2, and then subjected to a twist fatigue test. Further, a quenching heating temperature was maintained for 300 to 600 seconds, and then, cooled down to a temperature range of a room temperature at an average cooling rate of 10° C./s or more. The twist fatigue test was performed at a frequency of 10 Hz under the condition that a ratio of between the minimum stress and the maximum stress (stress ratio) was −1. The fatigue limit was obtained by finding the maximum stress that does not break down in the number of cycles of 2,000,000.

While the accumulation intensity is decreased even when the heat treatment is performed, the texture remained. In addition, the above manufacturing conditions also affect the characteristics of the hot stretch reduction electric resistance welded steel pipe before heat treatment.

When the obtained fatigue limit was 350 MPa or more, it was determined to be qualified with excellent fatigue characteristics. On the other hand, when the fatigue limit was less than 350 MPa, it was determined to be failed with no excellent fatigue characteristics.

In addition, after the heat treatment, Vickers hardness was measured by the above-mentioned method. The obtained results are shown in Table 4-1 and Table 4-2. Further, the quenching heating temperature was maintained for 300 to 600 seconds, and then, cooled down to the temperature range of the room temperature at an average cooling rate of 10° C./s or more.

When the obtained Vickers hardness was 450 Hv or more, it was determined to be qualified with high hardness. On the other hand, when the Vickers hardness is less than 450 Hv, it was determined to be failed with no high hardness.

TABLE 1-1

| Steel | Chemical composition (mass %) Remaining is Fe and impurities. | | | | | | | | | |
|---|---|---|---|---|---|---|---|---|---|---|
| type | C | Si | Mn | P | S | Al | Ti | B | N | Cr |
| A | 0.241 | 0.31 | 0.75 | 0.022 | 0.001 | 0.032 | 0.014 | 0.0050 | 0.0030 | 0.255 |
| B | 0.260 | 0.39 | 1.54 | 0.093 | 0.003 | 0.017 | 0.031 | 0.0050 | 0.0040 | |
| C | 0.242 | 0.47 | 1.65 | 0.030 | 0.000 | 0.080 | 0.052 | 0.0050 | 0.0050 | |
| D | 0.274 | 0.46 | 1.61 | 0.022 | 0.006 | 0.088 | 0.014 | 0.0030 | 0.0020 | 0.284 |
| E | 0.287 | 0.44 | 0.96 | 0.039 | 0.009 | 0.099 | 0.018 | 0.0010 | 0.0020 | 0.263 |
| F | 0.391 | 0.17 | 1.23 | 0.013 | 0.003 | 0.081 | 0.036 | 0.0020 | 0.0090 | 0.176 |
| G | 0.350 | 0.24 | 1.35 | 0.012 | 0.002 | 0.018 | 0.025 | 0.0020 | 0.0030 | 0.150 |
| H | 0.333 | 0.23 | 1.11 | 0.039 | 0.000 | 0.022 | 0.022 | 0.0020 | 0.0030 | |
| I | 0.274 | 0.36 | 0.82 | 0.012 | 0.010 | 0.022 | 0.032 | 0.0040 | 0.0035 | 0.099 |
| J | 0.244 | 0.29 | 1.24 | 0.022 | 0.006 | 0.099 | 0.059 | 0.0050 | 0.0040 | 0.180 |
| K | 0.250 | 0.27 | 0.91 | 0.047 | 0.000 | 0.049 | 0.046 | 0.0030 | 0.0070 | 0.055 |
| L | 0.366 | 0.49 | 0.76 | 0.063 | 0.009 | 0.077 | 0.015 | 0.0050 | 0.0010 | 0.260 |
| M | 0.292 | 0.33 | 0.88 | 0.006 | 0.005 | 0.064 | 0.013 | 0.0030 | 0.0030 | 0.280 |
| N | 0.300 | 0.12 | 1.24 | 0.046 | 0.004 | 0.068 | 0.049 | 0.0050 | 0.0050 | 0.207 |
| O | 0.373 | 0.35 | 0.87 | 0.045 | 0.000 | 0.046 | 0.037 | 0.0010 | 0.0030 | 0.189 |
| P | 0.270 | 0.34 | 0.71 | 0.034 | 0.004 | 0.081 | 0.052 | 0.0050 | 0.0060 | |
| Q | 0.270 | 0.29 | 1.20 | 0.093 | 0.006 | 0.051 | 0.011 | 0.0010 | 0.0020 | 0.170 |
| R | 0.240 | 0.36 | 1.20 | 0.002 | 0.005 | 0.051 | 0.012 | 0.0010 | 0.0035 | 0.071 |
| S | 0.220 | 0.35 | 1.34 | 0.041 | 0.008 | 0.092 | 0.051 | 0.0020 | 0.0050 | 0.270 |
| T | 0.221 | 0.50 | 1.10 | 0.010 | 0.009 | 0.040 | 0.055 | 0.0010 | 0.0100 | 0.242 |
| a | 0.450 | 0.13 | 1.53 | 0.047 | 0.005 | 0.048 | 0.021 | 0.0050 | 0.0010 | 0.040 |
| b | 0.190 | 0.40 | 1.65 | 0.005 | 0.009 | 0.056 | 0.016 | 0.0010 | 0.0010 | 0.223 |
| c | 0.220 | 0.60 | 1.55 | 0.002 | 0.007 | 0.011 | 0.054 | 0.0050 | 0.0050 | 0.167 |
| d | 0.242 | 0.02 | 0.55 | 0.056 | 0.007 | 0.096 | 0.047 | 0.0050 | 0.0030 | 0.300 |

| Steel | Chemical composition (mass %) Remaining is Fe and impurities. | | | | | | | | | |
|---|---|---|---|---|---|---|---|---|---|---|
| type | Mo | Cu | Ni | Nb | W | V | Ca | REM | Ti/N | Vc90 (° C./s) |
| A | | | | | | | | | 4.7 | 44 |
| B | | | | | | | | | 7.8 | 14 |
| C | | | | | | | | | 10.4 | 12 |
| D | | | | | | | | | 7.0 | 7 |
| E | | | | | | | | | 9.0 | 22 |
| F | | | | | | | | | 4.0 | 12 |
| G | | | | | | | | | 8.3 | 11 |
| H | 0.240 | | | | | | | | 7.3 | 10 |
| I | | 0.240 | 0.108 | | | | | | 9.1 | 37 |
| J | | | 0.150 | | | | | | 14.8 | 19 |
| K | | | | 0.049 | | | | | 6.6 | 44 |
| L | | | | | 0.001 | | | | 15.0 | 21 |
| M | | | | | | 0.150 | | | 4.3 | 26 |
| N | | | | | | | 0.0020 | | 9.8 | 18 |
| O | | | | | | | | 0.0010 | 12.3 | 21 |
| P | 0.200 | | | 0.029 | | | | 0.0010 | 8.7 | 29 |
| Q | 0.180 | | | 0.040 | | | 0.0030 | 0.0020 | 5.5 | 11 |
| R | 0.190 | | | | 0.003 | | 0.0050 | | 3.4 | 13 |
| S | 0.150 | | 0.200 | | 0.038 | | 0.0020 | | 10.2 | 8.5 |
| T | | | 0.130 | | 0.031 | 0.080 | 0.0020 | | 5.5 | 21 |
| a | | | | | | | | | 21.0 | 7 |
| b | | | | | | | | | 16.0 | 12 |
| c | | | | | | | | | 10.8 | 11 |
| d | | | | | | | | | 15.7 | 71 |

Underlines mean that the elements are outside the range of the present invention.

TABLE 1-2

| Steel type | Chemical composition (mass %) Remaining is Fe and impurities. C | Si | Mn | P | S | Al | Ti | B | N | Cr | Mo | Cu | Ni | Nb | W | V | Ca | REM | Ti/N | Vc90 (° C./s) |
|---|---|---|---|---|---|---|---|---|---|---|---|---|---|---|---|---|---|---|---|---|
| e | 0.370 | 0.41 | 2.20 | 0.039 | 0.003 | 0.091 | 0.054 | 0.0040 | 0.0080 | 0.210 | | | | | | | | | 6.8 | 2 |
| f | 0.397 | 0.20 | 0.40 | 0.035 | 0.005 | 0.045 | 0.049 | 0.0040 | 0.0060 | 0.121 | | | | | | | | | 8.2 | 51 |
| g | 0.355 | 0.29 | 1.26 | 0.110 | 0.002 | 0.059 | 0.036 | 0.0020 | 0.0080 | 0.104 | | | | | | | | | 4.5 | 13 |
| h | 0.298 | 0.26 | 0.93 | 0.077 | 0.015 | 0.068 | 0.059 | 0.0040 | 0.0060 | 0.041 | | | | | | | | | 9.8 | 35 |
| i | 0.357 | 0.37 | 1.56 | 0.041 | 0.004 | 0.150 | 0.052 | 0.0040 | 0.0090 | 0.114 | | | | | | | | | 5.8 | 7 |
| j | 0.337 | 0.44 | 1.21 | 0.075 | 0.007 | 0.086 | 0.025 | 0.0010 | 0.0030 | 0.550 | | | | | | | | | 8.3 | 8 |
| l | 0.364 | 0.37 | 1.22 | 0.038 | 0.001 | 0.026 | 0.070 | 0.0040 | 0.0003 | 0.201 | | | | | | | | | 233.3 | 11 |
| m | 0.319 | 0.36 | 0.97 | 0.029 | 0.006 | 0.078 | 0.001 | 0.0040 | 0.0070 | 0.267 | | | | | | | | | 0.1 | 20 |
| n | 0.248 | 0.29 | 1.00 | 0.044 | 0.007 | 0.098 | 0.036 | 0.0080 | 0.0090 | 0.164 | | | | | | | | | 4.0 | 32 |
| o | 0.287 | 0.13 | 1.09 | 0.095 | 0.004 | 0.100 | 0.040 | 0.0001 | 0.0090 | 0.028 | | | | | | | | | 4.4 | 172 |
| p | 0.255 | 0.49 | 0.83 | 0.022 | 0.007 | 0.031 | 0.060 | 0.0020 | 0.0150 | 0.237 | | | | | | | | | 4.0 | 33 |
| q | 0.330 | 0.43 | 0.59 | 0.076 | 0.003 | 0.064 | 0.023 | 0.0010 | 0.0090 | 0.021 | | | | | | | | | 2.6 | 49 |
| U | 0.355 | 0.28 | 1.26 | 0.082 | 0.008 | 0.012 | 0.047 | 0.0010 | 0.0080 | 0.071 | | | | | | | | | 5.9 | 14 |
| V | 0.339 | 0.19 | 1.34 | 0.100 | 0.006 | 0.099 | 0.045 | 0.0050 | 0.0050 | 0.105 | | | | | | | | | 9.0 | 13 |
| W | 0.368 | 0.33 | 1.54 | 0.096 | 0.008 | 0.054 | 0.044 | 0.0040 | 0.0080 | 0.284 | | | | | | | | | 5.5 | 6 |
| X | 0.350 | 0.45 | 0.89 | 0.058 | 0.008 | 0.048 | 0.034 | 0.0030 | 0.0090 | 0.215 | | | | | | | | | 3.8 | 20 |
| Y | 0.319 | 0.41 | 1.67 | 0.071 | 0.002 | 0.040 | 0.031 | 0.0020 | 0.0050 | 0.107 | | | | | | | | | 6.2 | 7 |
| Z | 0.284 | 0.33 | 0.77 | 0.046 | 0.005 | 0.085 | 0.045 | 0.0010 | 0.0040 | 0.183 | | | | | | | | | 11.3 | 38 |
| AA | 0.294 | 0.23 | 1.32 | 0.014 | 0.006 | 0.095 | 0.020 | 0.0020 | 0.0010 | 0.022 | | | | | | | | | 20.0 | 19 |
| AB | 0.372 | 0.29 | 1.46 | 0.003 | 0.002 | 0.097 | 0.055 | 0.0050 | 0.0030 | 0.216 | | | | | | | | | 18.3 | 8 |
| AC | 0.286 | 0.50 | 1.27 | 0.023 | 0.003 | 0.083 | 0.047 | 0.0050 | 0.0060 | 0.033 | | | | | | | | | 7.8 | 17 |
| AD | 0.233 | 0.28 | 0.60 | 0.049 | 0.000 | 0.084 | 0.022 | 0.0050 | 0.0050 | 0.016 | | | | | | | | | 4.4 | 84 |
| AE | 0.220 | 0.11 | 0.50 | 0.033 | 0.003 | 0.023 | 0.011 | 0.0020 | 0.0034 | 0.012 | | | | | | | | | 3.2 | 120 |
| AF | 0.242 | 0.47 | 1.65 | 0.030 | 0.000 | 0.080 | 0.052 | 0.0050 | 0.0050 | | | | | | | | | | 10.4 | 12 |

Underlines mean that the elements are outside the range of the present invention.

TABLE 2-1

| No. | Steel type | Hot stretch reduction: Heat temperature (° C.) | Holding time (s) | Number of passes (times) | Cumulative reduction ratio in temperature range of 650° C. or more (%) | Rolling time (s) | Cumulative reduction ratio in temperature range of 850° C. or less (%) | Finish temperature (° C./s) | Average cooling rate after hot stretch reduction (° C./s) | Heat treatment: Quenching heating temperature (° C.) | Tempering temperature (° C.) | Holding time upon tempering (° C.) | Note |
|---|---|---|---|---|---|---|---|---|---|---|---|---|---|
| 1 | A | 979 | 200 | 25 | 72.8 | 4 | 19.2 | 708 | 3 | 991 | 371 | 16 | Example |
| 2 | B | 973 | 250 | 23 | 73.0 | 7 | 28.6 | 749 | 3 | 882 | 269 | 32 | Example |
| 3 | C | 950 | 230 | 24 | 69.5 | 6 | 24.4 | 658 | 4 | 887 | 399 | 45 | Example |
| 4 | D | 990 | 50 | 25 | 57.0 | 5 | 18.0 | 658 | 3 | 904 | 249 | 58 | Example |
| 5 | E | 958 | 89 | 22 | 70.3 | 8 | 22.3 | 727 | 3 | 858 | 317 | 15 | Example |
| 6 | F | 940 | 90 | 22 | 75.1 | 9 | 13.5 | 675 | 1 | 984 | 328 | 7 | Example |
| 7 | G | 1045 | 150 | 23 | 66.3 | 8 | 23.3 | 722 | 2 | 932 | 411 | 15 | Example |
| 8 | H | 1067 | 20 | 22 | 69.5 | 6 | 17.5 | 747 | 3 | 895 | 332 | 47 | Example |
| 9 | I | 1015 | 30 | 21 | 67.5 | 9 | 17.6 | 688 | 4 | 966 | 247 | 51 | Example |
| 10 | J | 1016 | 89 | 23 | 72.8 | 9 | 24.6 | 690 | 3 | 898 | 221 | 24 | Example |
| 11 | K | 901 | 70 | 21 | 71.5 | 6 | 13.4 | 669 | 5 | 962 | 210 | 13 | Example |
| 12 | L | 1099 | 90 | 22 | 69.5 | 10 | 11.7 | 683 | 5 | 895 | 404 | 51 | Example |
| 13 | M | 1004 | 230 | 24 | 66.3 | 5 | 12.0 | 729 | 1 | 941 | 229 | 17 | Example |
| 14 | N | 946 | 180 | 20 | 69.5 | 7 | 14.2 | 683 | 3 | 946 | 403 | 27 | Example |
| 15 | O | 1039 | 190 | 22 | 75.1 | 9 | 25.4 | 729 | 3 | 912 | 321 | 49 | Example |
| 16 | P | 986 | 200 | 21 | 66.3 | 4 | 10.6 | 687 | 5 | 940 | 386 | 15 | Example |
| 17 | Q | 963 | 230 | 21 | 69.5 | 7 | 14.5 | 737 | 3 | 909 | 369 | 5 | Example |
| 18 | R | 1073 | 240 | 25 | 42.3 | 6 | 13.6 | 728 | 4 | 957 | 353 | 39 | Example |
| 19 | S | 969 | 270 | 23 | 69.5 | 5 | 20.5 | 728 | 4 | 897 | 297 | 8 | Example |
| 20 | T | 1094 | 280 | 22 | 67.5 | 9 | 16.6 | 725 | 5 | 899 | 201 | 8 | Example |
| 21 | a | 1011 | 290 | 21 | 72.8 | 10 | 11.4 | 672 | 3 | 958 | 356 | 53 | Comp. example |
| 22 | b | 1031 | 190 | 23 | 72.8 | 6 | 25.2 | 696 | 4 | 861 | 332 | 38 | Comp. example |
| 23 | c | 1090 | 210 | 23 | 69.5 | 9 | 26.0 | 730 | 1 | 877 | 220 | 17 | Comp. example |
| 24 | d | 917 | 220 | 22 | 67.5 | 9 | 16.1 | 665 | 3 | 891 | 249 | 35 | Comp. example |

Underlines mean that the elements are outside the range of the present invention and manufacturing conditions are not preferable.

TABLE 2-2

| | | Hot stretch reduction | | | | | | | | Heat treatment | | | |
|---|---|---|---|---|---|---|---|---|---|---|---|---|---|
| No. | Steel type | Heat temperature (° C.) | Holding time (s) | Number of passes (times) | Cumulative reduction ratio in temperature range of 650° C. or more (%) | Rolling time (s) | Cumulative reduction ratio in temperature range of 850° C. or less (%) | Finish temperature (° C./s) | Average cooling rate after hot stretch reduction (° C./s) | Quenching heating temperature (° C.) | Annealing temperature (° C.) | Holding time upon annealing (° C.) | Note |
| 25 | e | 919 | 210 | 20 | 71.5 | 6 | 27.6 | 745 | 4 | 863 | 315 | 54 | Comp. example |
| 26 | f | 980 | 220 | 25 | 69.5 | 7 | 11.6 | 657 | 3 | 989 | 302 | 54 | Comp. example |
| 27 | g | 904 | 230 | 25 | 66.3 | 8 | 21.8 | 748 | 3 | 957 | 319 | 52 | Comp. example |
| 28 | h | 1014 | 190 | 23 | 72.8 | 4 | 21.7 | 724 | 3 | 988 | 394 | 24 | Comp. example |
| 29 | i | 991 | 210 | 23 | 71.5 | 9 | 18.3 | 724 | 2 | 962 | 355 | 45 | Comp. example |
| 30 | j | 948 | 220 | 24 | 71.5 | 8 | 29.4 | 660 | 2 | 915 | 401 | 45 | Comp. example |
| 31 | l | 977 | 80 | 23 | 66.3 | 7 | 15.9 | 698 | 5 | 884 | 305 | 49 | Comp. example |
| 32 | m | 942 | 20 | 25 | 72.8 | 5 | 27.8 | 665 | 2 | 996 | 331 | 10 | Comp. example |
| 33 | n | 1015 | 180 | 21 | 72.8 | 7 | 16.8 | 705 | 4 | 887 | 234 | 36 | Comp. example |
| 34 | o | 1089 | 210 | 24 | 69.5 | 10 | 10.9 | 732 | 3 | 997 | 312 | 40 | Comp. example |
| 35 | p | 1095 | 220 | 24 | 67.5 | 7 | 13.1 | 710 | 5 | 948 | 399 | 8 | Comp. example |
| 36 | q | 916 | 190 | 24 | 71.5 | 9 | 11.1 | 734 | 1 | 990 | 200 | 27 | Comp. example |
| 37 | U | 1033 | 200 | 20 | 72.8 | 15 | 13.8 | 664 | 2 | 902 | 320 | 32 | Comp. example |
| 38 | V | 1095 | 210 | 21 | 69.5 | 13 | 23.0 | 705 | 4 | 917 | 312 | 6 | Comp. example |
| 39 | W | 910 | 200 | 20 | 67.5 | 6 | 42.0 | 695 | 1 | 891 | 332 | 43 | Comp. example |
| 40 | X | 901 | 40 | 22 | 71.5 | 9 | 43.0 | 660 | 2 | 994 | 351 | 58 | Comp. example |
| 41 | Y | 909 | 50 | 25 | 69.5 | 7 | 42.0 | 670 | 3 | 989 | 230 | 30 | Comp. example |
| 42 | Z | 904 | 35 | 25 | 66.3 | 7 | 44.0 | 656 | 4 | 945 | 324 | 23 | Comp. example |
| 43 | AA | 919 | 190 | 21 | 72.8 | 6 | 41.0 | 660 | 3 | 958 | 323 | 24 | Comp. example |
| 44 | AB | 1000 | 200 | 24 | 71.5 | 6 | 13.8 | 690 | 10 | 862 | 295 | 56 | Comp. example |

TABLE 2-2-continued

| | | Hot stretch reduction | | | | | | | | Heat treatment | | | |
|---|---|---|---|---|---|---|---|---|---|---|---|---|---|
| No. | Steel type | Heat temperature (° C.) | Holding time (s) | Number of passes (times) | Cumulative reduction ratio in temperature range of 650° C. or more (%) | Rolling time (s) | Cumulative reduction ratio in temperature range of 850° C. or less (%) | Finish temperature (° C./s) | Average cooling rate after hot stretch reduction (° C./s) | Quenching heating temperature (° C.) | Annealing temperature (° C.) | Holding time upon annealing (° C.) | Note |
| 45 | AC | 942 | 190 | 24 | 71.5 | 8 | 10.1 | 705 | 8 | 962 | 246 | 45 | Comp. example |
| 46 | AD | 1089 | 20 | 20 | 37.5 | 7 | 19.6 | 711 | 2 | 962 | 394 | 45 | Comp. example |
| 47 | AE | 950 | 190 | 23 | 71.0 | 5 | 21.3 | 708 | 3 | 910 | 280 | 10 | Comp. example |
| 48 | AF | 1150 | 30 | 23 | 72.8 | 6 | 20.2 | 708 | 3 | 910 | 300 | 30 | Comp. example |

Underlines mean that the elements are outside the range of the present invention and manufacturing conditions are not preferable.

TABLE 3-1

| No. | Steel pipe Outer diameter (mm) | Hot-stretch-reduced electric resistance welded pipe Wall thickness t (mm) | Outer diameter D (mm) | t/D (%) |
|---|---|---|---|---|
| 1 | 79 | 3 | 21 | 14 |
| 2 | 99 | 4 | 27 | 15 |
| 3 | 149 | 5 | 45 | 11 |
| 4 | 88 | 6 | 38 | 16 |
| 5 | 140 | 10 | 42 | 23 |
| 6 | 138 | 10 | 34 | 29 |
| 7 | 113 | 6 | 38 | 16 |
| 8 | 129 | 11 | 39 | 28 |
| 9 | 127 | 12 | 41 | 29 |
| 10 | 51 | 4 | 14 | 29 |
| 11 | 143 | 11 | 41 | 27 |
| 12 | 105 | 9 | 32 | 28 |
| 13 | 119 | 8 | 40 | 20 |
| 14 | 102 | 5 | 31 | 16 |
| 15 | 83 | 6 | 21 | 29 |
| 16 | 30 | 3 | 10 | 30 |
| 17 | 41 | 3 | 13 | 24 |
| 18 | 62 | 10 | 36 | 28 |
| 19 | 124 | 11 | 38 | 29 |
| 20 | 137 | 12 | 44 | 27 |
| 21 | 140 | 11 | 38 | 29 |
| 22 | 127 | 10 | 34 | 29 |
| 23 | 144 | 11 | 44 | 25 |
| 24 | 106 | 9 | 35 | 26 |

TABLE 3-2

| No. | Steel pipe Outer diameter (mm) | Hot-stretch-reduced electric resistance welded pipe Wall thickness (mm) | Outer diameter (mm) | t/D (%) |
|---|---|---|---|---|
| 25 | 125 | 10 | 36 | 28 |
| 26 | 109 | 9 | 33 | 27 |
| 27 | 85 | 8 | 29 | 28 |
| 28 | 161 | 7 | 44 | 16 |
| 29 | 70 | 4 | 20 | 20 |
| 30 | 117 | 5 | 33 | 15 |
| 31 | 106 | 10 | 36 | 28 |
| 32 | 140 | 11 | 38 | 29 |
| 33 | 158 | 12 | 43 | 28 |
| 34 | 147 | 13 | 45 | 29 |
| 35 | 95 | 9 | 31 | 29 |
| 36 | 100 | 8 | 29 | 28 |
| 37 | 147 | 6 | 40 | 15 |
| 38 | 91 | 5 | 28 | 18 |
| 39 | 114 | 10 | 37 | 27 |
| 40 | 113 | 9 | 32 | 28 |
| 41 | 146 | 8 | 44 | 18 |
| 42 | 106 | 10 | 36 | 28 |
| 43 | 118 | 9 | 32 | 28 |
| 44 | 121 | 10 | 34 | 29 |
| 45 | 133 | 11 | 38 | 29 |
| 46 | 70 | 10 | 43 | 23 |
| 47 | 135 | 11 | 39 | 28 |
| 48 | 79 | 3 | 21 | 14 |

TABLE 4-1

| No. | Steel type | Weld portion Ferrite (area %) | Pearlite (area ratio) | Remaining structure | Average grain diameter of micro structure (μm) | Accumulation intensity of {001} plane | Crack incidence rate (%) | Flattening test results | Hardness after heat treatment (Hv) | Fatigue limit (MPa) | Note |
|---|---|---|---|---|---|---|---|---|---|---|---|
| 1 | A | 44 | 56 | P | 4.2 | 3.9 | 0.0 | OK | 470 | 350 | Example |
| 2 | B | 29 | 71 | P | 5.6 | 3.3 | 0.0 | OK | 540 | 410 | Example |
| 3 | C | 76 | 23 | P, B/M | 5.5 | 4.1 | 0.0 | OK | 540 | 350 | Example |
| 4 | D | 40 | 60 | P | 4.4 | 4.3 | 0.0 | OK | 540 | 390 | Example |
| 5 | E | 31 | 69 | P | 7.3 | 3.7 | 0.0 | OK | 530 | 430 | Example |
| 6 | F | 60 | 40 | P | 8.1 | 4.5 | 0.0 | OK | 550 | 370 | Example |
| 7 | G | 63 | 36 | P, B/M | 7.6 | 3.9 | 0.0 | OK | 510 | 400 | Example |
| 8 | H | 38 | 62 | P | 6.3 | 4.7 | 0.0 | OK | 540 | 350 | Example |
| 9 | I | 53 | 47 | P | 8.2 | 3.5 | 0.0 | OK | 460 | 370 | Example |
| 10 | J | 59 | 40 | P, B/M | 7.9 | 2.9 | 0.0 | OK | 490 | 360 | Example |
| 11 | K | 69 | 31 | P | 5.8 | 3.0 | 0.0 | OK | 530 | 360 | Example |
| 12 | L | 75 | 25 | P | 9.4 | 4.9 | 0.0 | OK | 540 | 380 | Example |
| 13 | M | 26 | 74 | P | 4.7 | 4.1 | 0.0 | OK | 530 | 360 | Example |
| 14 | N | 67 | 33 | P | 6.0 | 3.9 | 0.0 | OK | 520 | 390 | Example |
| 15 | O | 23 | 77 | P | 8.5 | 3.5 | 0.0 | OK | 470 | 430 | Example |
| 16 | P | 43 | 57 | P | 4.1 | 3.2 | 0.0 | OK | 460 | 360 | Example |
| 17 | Q | 54 | 46 | P | 6.7 | 5.0 | 0.0 | OK | 490 | 395 | Example |
| 18 | R | 28 | 72 | P | 5.5 | 3.4 | 0.0 | OK | 540 | 370 | Example |
| 19 | S | 72 | 28 | P | 4.3 | 3.6 | 0.0 | OK | 540 | 430 | Example |
| 20 | T | 31 | 69 | P | 8.9 | 5.0 | 0.0 | OK | 480 | 420 | Example |
| 21 | a | 32 | 68 | P | 8.6 | 3.3 | 0.4 | NG | 500 | 420 | Comp. example |
| 22 | b | 52 | 48 | P | 5.5 | 4.5 | 0.0 | OK | 430 | 370 | Comp. example |
| 23 | c | 32 | 68 | P | 7.9 | 3.1 | 0.4 | NG | 520 | 330 | Comp. example |
| 24 | d | 33 | 67 | P | 7.3 | 4.1 | 0.0 | OK | 440 | 325 | Comp. example |

Underlines mean that the elements are outside the range of the present invention and manufacturing conditions are not preferable.

TABLE 4-2

| No. | Steel type | Weld portion: Ferrite (area %) | Pearlite (area ratio) | Remaining structure | Average grain diameter of micro structure (μm) | Accumulation intensity of {001} plane | Crack incidence rate (%) | Flattening test results | Hardness after heat treatment (Hv) | Fatigue limit (MPa) | Note |
|---|---|---|---|---|---|---|---|---|---|---|---|
| 25 | e | 34 | 66 | P | 5.2 | 4.3 | 0.0 | OK | 550 | 340 | Comp. example |
| 26 | f | 41 | 59 | P | 6.8 | 4.6 | 0.0 | OK | 430 | 410 | Comp. example |
| 27 | g | 29 | 71 | P | 7.6 | 3.6 | 0.4 | NG | 450 | 320 | Comp. example |
| 28 | h | 43 | 57 | P | 4.2 | 5.0 | 0.4 | NG | 460 | 330 | Comp. example |
| 29 | i | 60 | 40 | P | 8.2 | 3.5 | 0.4 | NG | 480 | 360 | Comp. example |
| 30 | j | 43 | 57 | P | 7.8 | 4.1 | 0.4 | NG | 530 | 330 | Comp. example |
| 31 | l | 28 | 72 | P | 5.8 | 3.3 | 0.4 | NG | 530 | 430 | Comp. example |
| 32 | m | 30 | 70 | P | 11.0 | 4.7 | 0.4 | NG | 530 | 430 | Comp. example |
| 33 | n | 80 | 20 | P | 7.1 | 5.0 | 0.0 | OK | 420 | 320 | Comp. example |
| 34 | o | 78 | 22 | P | 9.3 | 3.1 | 0.0 | OK | 440 | 320 | Comp. example |
| 35 | p | 72 | 28 | P | 7.6 | 4.8 | 0.0 | OK | 415 | 310 | Comp. example |
| 36 | q | 69 | 31 | P | 9.0 | 3.0 | 0.0 | OK | 400 | 360 | Comp. example |
| 37 | U | 31 | 69 | P | 13.7 | 3.7 | 0.4 | NG | 540 | 370 | Comp. example |
| 38 | V | 65 | 35 | P | 13.0 | 4.0 | 0.4 | NG | 530 | 350 | Comp. example |
| 39 | W | 47 | 53 | P | 2.7 | 6.4 | 0.4 | NG | 540 | 410 | Comp. example |
| 40 | X | 70 | 30 | P | 4.3 | 7.0 | 0.4 | NG | 470 | 410 | Comp. example |
| 41 | Y | 22 | 78 | P | 5.2 | 7.0 | 0.8 | NG | 520 | 410 | Comp. example |
| 42 | Z | 73 | 27 | P | 5.9 | 7.2 | 0.8 | NG | 490 | 400 | Comp. example |
| 43 | AA | 73 | 27 | P | 4.3 | 6.5 | 0.4 | NG | 540 | 360 | Comp. example |
| 44 | AB | 15 | 84 | P, B/M | 7.3 | 5.8 | 0.4 | NG | 530 | 350 | Comp. example |
| 45 | AC | 12 | 87 | P, B/M | 7.3 | 4.9 | 0.4 | NG | 550 | 350 | Comp. example |
| 46 | AD | 36 | 64 | P | 11.0 | 3.0 | 0.4 | NG | 480 | 350 | Comp. example |
| 47 | AE | 90 | 10 | P | 9.5 | 6.5 | 0.4 | NG | 480 | 390 | (Comp. example) |
| 48 | AF | 60 | 40 | P | 11.0 | 4.3 | 0.4 | NG | 470 | 400 | (Comp. example) |

Underlines mean that the elements are outside the range of the present invention and characteristics are not preferable.

Reviewing Table 4-1 and Table 4-2, it can be seen that the hot-stretch-reduced electric resistance welded pipe according to the example of the present invention has high hardness and excellent flattening performance and fatigue characteristics.

On the other hand, it can be seen that hot-stretch-reduced electric resistance welded pipes according to comparative examples are inferior in one or more of the characteristics.

No. 21 is an example in which a flattening performance deteriorated due to a high C content.

No. 22 is an example in which hardness deteriorated due to a low C content.

No. 23 is an example in which a flattening performance and fatigue characteristics deteriorated due to a high Si content.

No. 24 is an example in which hardness and fatigue characteristics deteriorated due to a low Si content.

No. 25 is an example in which fatigue characteristics deteriorated due to a high Mn content.

No. 26 is an example in which hardness deteriorated due to a low Mn content.

No. 27 is an example in which a flattening performance and fatigue characteristics deteriorated due to a high P content.

No. 28 is an example in which a flattening performance and fatigue characteristics deteriorated due to a high S content.

No. 29 is an example in which a flattening performance deteriorated due to a high Al content.

No. 30 is an example in which a flattening performance and fatigue characteristics deteriorated due to a high Cr content.

No. 31 is an example in which a flattening performance deteriorated due to a high Ti content.

No. 32 is an example in which a flattening performance deteriorated due to a low Ti content.

No. 33 is an example in which hardness and fatigue characteristics deteriorated due to a high B content.

No. 34 is an example in which hardness and fatigue characteristics deteriorated due to a low B content.

No. 35 is an example in which the hardness and fatigue characteristics deteriorated due to a high N content.

No. 36 is an example in which hardness deteriorated due to high Ti/N.

No. 37 and No. 38 are examples in which a flattening performance deteriorated because the rolling time of hot stretch reduction was long and the average grain diameter of the microstructure was large.

Nos. 39 to 43 are examples in which the a flattening performance deteriorated due to the large cumulative reduction ratio in the temperature range of 850° C. or less and the large accumulation intensity of the {001} plane in the texture.

No. 44 and No. 45 are examples in which the flattening performance deteriorated because the average cooling rate after hot stretch reduction was large and the area ratio of ferrite was small.

No. 46 is an example in which the flattening performance deteriorated because the cumulative reduction ratio was small in the temperature range of 650° C. or more and the accumulation intensity of the {001} plane in the texture was large.

Since No. 47 had a high Vc90, the ferrite fraction was high even in the range of the condition of the above-mentioned hot stretch reduction, and the accumulation intensity could not be satisfied.

In No. 48, the heating temperature exceeded 1100° C., so the average grain diameter of the microstructure exceeded 10 μm. For this reason, the flattening performance deteriorated.

INDUSTRIAL APPLICABILITY

According to the aspect of the present invention, it is possible to provide the hot-stretch-reduced electric resistance welded pipe having an excellent flattening performance, and excellent fatigue characteristics and high hardness after heat treatment.

The hot-stretch-reduced electric resistance welded pipe according to the aspect can be appropriately applied to the undercarriage parts for an automobile, for example, a stabilizer.

What is claimed is:

1. A hot-stretch-reduced electric resistance welded pipe comprising:

a base metal portion and a weld portion, a chemical composition of the base metal portion including, in mass %, C: 0.210 to 0.400%, Si: 0.05 to 0.50%, Mn: 0.50 to 1.70%, P: 0.100% or less, S: 0.010% or less, N: 0.0100% or less, Al: 0.010 to 0.100%, Ti: 0.010 to 0.060%, B: 0.0005 to 0.0050%, Cr: 0 to 0.500%, Mo: 0 to 0.500%, Cu: 0 to 1.000%, Ni: 0 to 1.000%, Nb: 0 to 0.050%, W: 0 to 0.050%, V: 0 to 0.500%, Ca: 0 to 0.0050%, and REM: 0 to 0.0050%, wherein a remaining being Fe and impurities, a Ti/N value obtained by dividing Ti content by N content is 3.0 or more, in a microstructure of the weld portion, an average grain diameter is 9.4 μm or less, an area ratio of ferrite is 20% or more, and a remaining structure includes at least one selected from the group consisting of pearlite, bainite, and martensite, and in a texture of the weld portion, an accumulation intensity of a {001} plane is 6.0 or less, a critical cooling rate Vc90 of the base metal portion is 5° C./s to 90° C./s, and the critical cooling rate Vc90 is expressed as the following equation (1), providing that a C content (mass %) is [C], a Si content (mass %) is [Si], a Mn content (mass %) is [Mn], a Cr content (mass %) is [Cr], a Mo content (mass %) is [Mo], and a Ni content (mass %) is [Ni], $$\log_{10} Vc90=2.94-0.75\times\beta \quad (1)$$

$$\beta=2.7\times[C]+0.4\times[Si]+[Mn]+0.8\times[Cr]+2[Mo]+0.45\times[Ni] \quad (2).$$

2. The hot-stretch-reduced electric resistance welded pipe according to claim 1, wherein the chemical composition includes, in mass %, at least one or two or more selected from the group consisting of:

Mo: 0.010 to 0.500%,

Cu: 0.010 to 1.000%,

Ni: 0.010 to 1.000%,

Nb: 0.005 to 0.050%,

W: 0.010 to 0.050%,

V: 0.010 to 0.500%,

Ca: 0.0001 to 0.0050%, and

REM: 0.0001 to 0.0050%.

* * * * *